US005093159A

United States Patent [19]

Fernandez et al.

[11] Patent Number: 5,093,159

[45] Date of Patent: Mar. 3, 1992

[54] PROCESS FOR RAPIDLY IMMOBILIZING PAPER COATING COMPOSITIONS

[75] Inventors: Joseph Fernandez, Duluth, Minn.; Daniel Solarek, Belle Mead; John Koval, Baptistown, both of N.J.

[73] Assignee: National Starch and Chemical Investment Holding Corporation, Wilmington, Del.

[21] Appl. No.: 431,944

[22] Filed: Nov. 6, 1989

[51] Int. Cl.[5] ..... B05D 3/02

[52] U.S. Cl. ..... 427/342; 427/341; 427/391; 427/395; 106/213; 106/214

[58] Field of Search ..... 427/396, 395, 391, 361, 427/339, 342, 341; 162/175, 136; 106/213, 214

[56] References Cited

U.S. PATENT DOCUMENTS

| | | | |
|---|---|---|---|
| Re. 26,510 | 12/1968 | Mazzarella et al. | 106/210 |
| 2,727,837 | 7/1952 | Gregory | 427/395 |
| 2,973,285 | 2/1961 | Berke et al. | 427/341 |
| 3,052,561 | 9/1962 | Kronfeld | 106/214 |
| 3,211,564 | 10/1965 | Lauterbach | 106/214 |
| 3,268,510 | 8/1966 | Nagy | 260/233.3 |
| 3,654,263 | 4/1972 | Cescato | 106/214 |
| 3,655,436 | 4/1972 | Dupre | 117/139.5 C |
| 3,775,172 | 11/1973 | Clark | 427/301 |
| 3,884,853 | 5/1975 | Zimmerman | 524/47 |
| 3,928,707 | 12/1975 | Lauterbach et al. | 428/342 |
| 4,164,595 | 8/1979 | Adams et al. | 427/395 |
| 4,243,479 | 1/1981 | Tessler | 162/175 |
| 4,393,202 | 7/1983 | Breuninger | 106/213 |
| 4,732,786 | 3/1988 | Patterson et al. | 427/261 |
| 4,804,414 | 2/1989 | Gleason | 106/214 |

*Primary Examiner*—Michael Lusignan
*Assistant Examiner*—Diana L. Dudash
*Attorney, Agent, or Firm*—Ellen T. Dec; Jane E. Gennaro; Edwin M. Szala

[57] ABSTRACT

Rapidly immobilizing paper coating compositions may be prepared by formulating an aqueous coating composition comprising a cationic starch, pigment and sufficient base to obtain a pH above the pK of the starch derivative so that the starch is no longer cationic; coating the paper substrate; and lowering the pH of the coating such that the starch becomes cationic.

20 Claims, No Drawings

PROCESS FOR RAPIDLY IMMOBILIZING PAPER COATING COMPOSITIONS

BACKGROUND OF THE INVENTION

Coating compositions comprising a pigment and binder are generally employed in the manufacture of paper in order to improve its printing properties, optical characteristics and appearance. It is well known that a paper coating composition must have certain characteristics in order to perform these functions; in particular, it must have the proper viscosity and rheological characteristics to permit its application to the paper by modern high-speed machines and to spread properly on the paper. Moreover, the binder, which serves to bind the pigment and to adhere the coating to the paper surface, must be such that it will provide a uniform, homogeneous coating film that will withstand the stresses encountered during subsequent printing and/or converting operations.

In utilizing paper coating compositions, it is most desired that the coatings, once applied, will be rapidly immobilized on the paper web surface. Such rapid immobilization results in improved fiber coverage, decreased coating densification and minimized binder migration. These coating structural effects then provide potential benefits such as improved fiber covering power, increased opacification, smoother surface and better printing characteristics on the final coated paper substrate.

Previous attempts to achieve rapid immobilization of paper coating compositions involved the use of cationic starches and proteins to produce partially flocculated coatings which gained viscosity rapidly upon the solids increase that occurred subsequent to the coating process. However, these approaches were not totally satisfactory and found limited application since they often produced paper coatings with unacceptable rheological characteristics.

SUMMARY OF THE INVENTION

The present invention is directed to a process for rapidly immobilizing paper coating compositions comprising the steps of:

1) formulating an aqueous coating composition comprising a cationic starch, pigment and sufficient base to obtain a pH above the pK of the starch derivative so that the starch is no longer cationic;
2) coating the paper substrate;
3) lowering the pH of the coating such that the starch becomes cationic either by drying the coating so as to evaporate the base, or by reaction with a sufficient amount of an acidic component.

The process of the present invention thus produces a stable dispersed paper coating composition which can be applied easily with high speed coaters and later will be rapidly immobilized by a pH drop, such as that which occurs during the drying process.

Although any non-quaternary amine containing cationic starch may be utilized in accordance with the process of invention, particularly useful are cationic starch derivatives such as the chloroethylmorpholine derivatives which have a relatively low pK value and require only a small amount of base to maintain the starch in its non-cationic state; correspondingly requiring the release of only a small amount of base to induce immobilization.

While some of these cationic starches have been suggested previously for use in paper coating compositions, the starches were always formulated and applied within a pH range at which the starch exhibited cationic properties and consequently the coatings increased in viscosity too quickly and thus were difficult to utilize, particularly in high speed coating operations.

DETAILED DESCRIPTION OF THE PREFERRED EMBODIMENTS

Among the cationic starches which meet the criteria for use herein are the following classes of compositions;

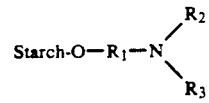

(I)

in which $R_1$ is an alkylene or hydroxyalkylene of 1 to 6 carbons, alkenylene of 2 to 6 carbons, alkylenoxy of 2 to 4 carbons, or polyalkylenoxy having 2 to 4 carbons per monomer unit, and from 2 to 20 units per substituent, and $R_2$ and $R_3$ taken individually are:

a.) alkyl, straight or branched, hydroxyalkyl, thioalkyl or alkoxyalkyl all of 1 to 18 carbons, or alkenyl of 2 to 18 carbons; or cycloalkyl from three to six carbons; aryl, like phenyl or naphthyl; arylalkyl from 7 to 18 carbons, like benzyl or phenethyl; or alkyl aryl, from seven to 18 carbons, like tolyl; or b.) $R_1$ and $R_2$ or $R_2$ and $R_3$ taken collectively with the nitrogen atom to which they are joined, to form a heterocyclic saturated or unsaturated five or six membered ring, like morpholino and picolyl.

Also useful are cationic starches of the formula

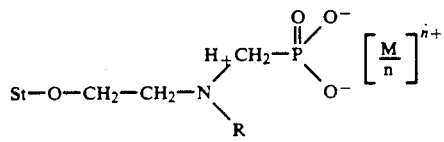

(II)

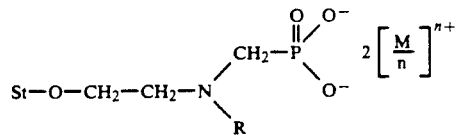

(III)

wherein St—O— represents a starch molecule or a modified starch molecule (wherein the hydrogen of a hydroxyl group of an anhydroglucose unit has been replaced as shown);

R is a $C_1$–$C_6$ straight or branched chain alkyl group, a $C_3$–$C_6$ cycloalkyl group or a

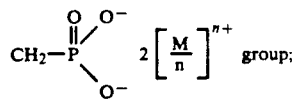

group;

M is the same or different cation(s); and n is the valence number of M.

The preparation of such starches described in U.S. Pat. No. 4,243,479 issued Jan. 6, 1981 to Martin M. Tessler.

Also useful herein are starches onto which a polymeric group, containing repeating ionizable nitrogen atoms, has been grafted, through a carbon, oxygen, nitrogen, or sulfur atom, such as a polyvinyl imidazol, or polymorpholinoethylmethacrylate, or other ethylenically unsaturated acid derivatives.

Amine oxide containing cationic starches may also be employed. This class of cationic starch can be prepared by utilizing inactive reagents containing amine oxide functionality. Alternatively, a tertiary amine reagent can be used to form a cationic starch and the adduct subjected to oxidation to convert the amine to the amine oxide. This class of starches is represented by the formula:

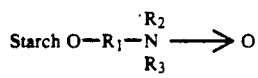

(IV)

where $R_1$ is an alkylene or hydroxyalkylene of one to six carbons, alkenylene of two to six carbons, alkyleneoxy of 2 to 4 carbons, or polyalkyleneoxy having 2 to 4 carbons per monomer unit, and from 2 to 20 units per substituent; and $R_1$, $R_2$ and $R_3$ are as defined I above. In each instance, the substituted starch has a pK in the range of 3 to 8, with those starches having pK above about 5 being preferred for use herein.

Also, comprehended by this invention are substituted cationic starches containing more than one of the same or different type of ionizable nitrogen-bearing groups on the same starch substituent, as well as mixtures of different classes of the above described substituted starches. Representative of some of these are the starch derivatives described in copending application Ser. No. 376,779 filed July 7, 1989.

It will also be recognized that the corresponding esters of any of the previously described starch derivatives may also be employed in the process of the present invention.

Illustrative of reactants which will combine with starch to form a cationic starch of the herein defined requisite properties are the following:

N-(2-chloroethyl)-morpholine
N-(2-chloropropyl)-morpholine
N-(2-chloroisobutyl)-morpholine
N-(2-chloropentyl)-morpholine
N-(2-Bromohexyl)-morpholine
N,N-Diisopropyl-2,3-epoxypropylamine
N-Ethyl-N-2-hydroxyethyl-2,3-epoxypropylamine
N-methyl-N-2-Hydroxyethyl-2,3-epoxypentylamine
N,N-Diisoamyl-2,3-epoxypentylamine
N-hexyl-N-2-hydroxyethyl-2,3-epoxybutylamine
N,N-Diisoheptyl-2,3-epoxybutylamine
N-phenyl-N-ethyl-2,3-epoxypropylamine
N-methyl-N-napthyl-2,3-epoxypropylamine
N-propyl-N-(2-hydroxyethyl-)-2,3-epoxybutylamine
N,N-diisopropyl-2,3-epoxypentylamine
N,N-bis-2-hydroxypropyl-2,3-epoxypropylamine
N,N-bis-2-hydroxybutyl-2,3-epoxyhexylamine
N,N-bis-2-hydroxyisopropyl-2,3-epoxybutylamine
N,N-bis-2-hydroxyisoamyl-2,3-epoxypentylamine
N-(2,3-epoxypropyl)-morpholine
N-(2,3-epoxyhexyl)-morpholine
N-(2,3-epoxyhexyl)-morpholine
N-(2,3-epoxyisoamyl)-morpholine
N-(2-chloroethyl)-N-ethylaniline
N-(2-bromoethyl)-N-butylaniline
N-(2-chloropropyl)-N-isopropylaniline
N-(2-chlorobutyl)-N-pentylaniline
N-(2-chloroethyl)-N-morpholine-N-oxide
N-(2-chloroethyl)-N,N-diethylamine-N-oxide
N-(2,3-epoxypropyl)-morpholine-N-oxide
N-(2-chloroethyl)N-benzyl-N-methylamine
N-(2-chloroethyl)N-benzyl N-(2-methoxyethyl)amine
3-picoylchloride
4-picoylchloride
N-(2-chloroethyl)iminobis-(methylene)diphosphonic acid
Diethylaminoethylchloride
4-(2-chloroethyl)morpholine hydrochloride
1,3-Bis(Morpholino)-2-chloropropane
2-(N-chloroacetomido-propyl)pyridine To achieve the maximum benefits of the invention, it is generally necessary to have sufficient cationic moieties in the paper coating formulation. This level of cationicity may be achieved either by utilizing a sufficient degree of cationic treatment depending on the particular type and water fluidity of the starch base or by formulating the paper coating with sufficient levels of the cationic starch.

The applicable starch bases which may be used in preparing the cationic starches for use herein may be derived from any plant source including corn, potato, sweet potato, wheat, rice, sago, tapioca, waxy maize, sorghum, high amylose corn, or the like. Also included are the conversion products derived from any of the latter bases including, for example, dextrins prepared by the hydrolytic action of acid and/or heat; oxidized starches prepared by treatment with oxidants such as sodium hypochlorite; fluidity or thin-boiling starches prepared by enzyme conversion or mild acid hydrolysis; and neutral or anionical starch derivatives. Also included within the scope of the invention are products based on polysaccharides prepared from materials other than starch, including gums, cellulose and the like.

It is well known that starch in its natural state exists in the form of discrete granules, which in the presence of water and heat or certain chemicals (such as strong alkalis) undergo gelatinization. The phenomenon of gelatinization involves the swelling, rupture and disintegration of the starch granules, so that they disperse in water to form a homogeneous hydrated collodial dispersion. Starch which has been thus gelatinized and dried, will, upon subsequent mixing with water, disperse without the aid of heat. On the other hand, ungelatinized starch will quickly settle out of a water suspension, unless sufficient heat is applied to gelatinize and disperse the granules (this is referred to as "cooking" the starch, to form a useable dispersion). The cationic starch derivatives may be prepared in either the ungelatinized or gelatinized form, and both are suitable for use herein. In order to produce the starch derivatives in ungelatinized form, it is of course necessary to avoid those conditions of heat or alkalinity during the reaction which will cause the starch to gelatinize, or, alternatively, to add a known gelatinization retarder such as sodium sulfate to the reaction mass. A product thus made can be filtered and washed, since it is in the original granule form. On the other hand, a gelatinized starch derivative may be made by permitting gelatinization of the reaction mass, by using sufficient heat and/or alkali. This gelatinized mass may, if desired, be dried as by passing over heated drums. Alternatively, the starch derivative may be made in ungelatinized form, filtered and washed if desired, resuspended in water and passed over drums heated sufficiently so as to gelatinize and dry starch product, which will then be in the so-called cold water soluble form.

Virtually any alkaline material can be used to raise the pH to above the pK of the cationic starch. For ease in removal of the alkali and consequent lowering of the pH to effect the desired immobilization, it is preferred to use a fugitive alkali which will readily evaporate during the drying step. Suitable fugitive alkali include ammonium hydroxide as well as the volatile amine bases such as trimethylamine. It may, however, be desired in some cases to use a non-volatile base such as calcium carbonate (which could also function as a pigment component in the "pigment slip") or an alkaline earth metal such as sodium or potassium hydroxide. Obviously, any combination of the above alkaline materials may also be employed.

In formulating the paper coatings according to the present invention, sufficient alkali is added so as to achieve a pH at which the starch is not cationic, i.e., a pH sufficiently above the pK of the particular cationic substituent. It is desirable to add only so much alkali as will provide the pH range needed to achieve a zero point charge since any excess base added above such level will also have to be removed or neutralized in order to immobilize the paper coating.

The pK of a cationic starch is a means of describing the relationship of its degree of ionization, and the pH of the system. The cationic starches of interest are weak bases, where the ionizable substituents can exist in the protonated (positively charged) form, or in the non-protonated nonionic form, depending on the concentration of hydrogen ion present, which is expressed by pH. For the polyelectrolyte cationic starches, we have defined pK as equal numerically to the pH at the point of 50% ionization. Thus at a pH above the pK, the starch is less than 50% cationic and at pH's below the pK, it is greater than 50% cationic. The pK can be calculated from pH titration curves taken of the cationic starch with strong acids and bases.

The particular pH at which the zero point charge will be achieved depends upon the particular starch derivative employed. The following chart illustrates ranges for representative cationic starches.

| Starch Derivative | pK (approx.) | pH needed for zero point charge |
|---|---|---|
| 1,3-Bis(morpholine)-2-chloropropane | 6.5 | 8-8.5 |
| 2-(N-chloroacetamido-propyl) pyridine | 5.5 | 7-7.5 |
| N-(2-chloroethyl)iminobis (methylene)diphosphonic acid | 7.5 | 9-9.5 |
| Chloroethylmorpholine | 6.5 | 8-8.5 |
| Diethylaminoethyl chloride | 10 | 11-12 |

It will be recognized that the particular derivatives most preferred for use herein are those which have zero point charge values only slightly above the pH at which the coating formulation is to be applied so as to require the evaporation of only small quantities of base in order to effectively immobilize the paper coating.

The cationic starch derivative may be used in any desired proportion to replace part or all of the standard coating binder. Thus, the cationic starch may also be used together with at least one co-binder, such as ordinary starch (whether raw, or converted by enzymes, or otherwise), casein, protein or one or more polymers such as polyvinyl acetate, polyvinyl acetate-acrylate copolymers, acrylic copolymers, ethylene vinyl acetate copolymers, styrene butadiene or styrene acrylate latices as conventionally employed.

The preparation of paper coating compositions is well known. In general, it involves the making of the "pigment slip," which is merely a mixture of coating-grade pigments such as clay or titanium dioxide in water, with a dispersing agent such as sodium hexametaphosphate and an alkaline material such as sodium hydroxide. The latter two function to give the optimum dispersion of the pigment. To this "pigment slip" is added the starch or other binder. If the starch is in ungelatinized form, as is customarily the case, it is first "cooked" in water, that is, heated to a temperature beyond the gelatinization point of the starch, and this starch cook is then added, with agitation, to the pigment slip; or the starch may be cooked in the presence of none, a portion of or all of the pigment. If the starch is a pregelatinized, cold water soluble type, it can be dispersed in cold water, and the dispersion added to the pigment slip, or less preferably, the dry cold water soluble starch may be added directly to the pigment slip and dispersed by sufficient stirring. The proportions of the various ingredients of the coating composition will naturally be subject to much variance, depending upon the particular type of pigment and binder employed, the method of applying the coating, the properties desired in the final coated product, etc. However, in general, the pigment slip may contain from about 20% to 75%, by weight, of pigment and about 0.3% of sodium hexametaphosphate or other dispersing agent, based on the weight of the pigment. The pH of the pigment slip should preferably be from 6.5 to 9.5, depending on the pigment utilized. The starch cook ordinarily has a starch solids content of from 5% to 40%. When the starch and other coating components are mixed with the pigment slip, the amounts of the components in the final coating composition should ordinarily fall within the following weight ranges: 10 to 95% pigment, 5 to 90% binders (natural or synthetic) of which at least about 1% should be the cationic starch although higher levels (i.e. up to the total 90% may comprise the cationic starch) may be used and 0 to 5% additives (e.g. defoamers, lubricants, plasticizers, insolubilizers, stabilizers, etc.); the paper coating composition being formulated in water to a solids range of 20 to 80% by weight as is conventional in the art.

The alkali-containing paper coating composition is applied to the paper web using conventional techniques such as air knife coater, roll coater, rod coater, trailing blade, size press, etc.

Most commonly, if a fugitive alkali was used initially to formulate the paper coating composition, the evaporation which occurs during the conventionally employed drying step is sufficient to lower the pH to a point at which the starch derivative becomes cationic with the subsequent desired flocculation and rapid immobilization of the paper coating. The immobilization may also be accomplished by reaction with a sufficient amount of a component having a pH below the pK of the cationic starch.

The following examples will illustrate the embodiment of the invention. All parts given are by weight, unless otherwise specified. The viscosity data was obtained on a coating formulation prepared at 60% solids and tested on a Brookfield viscometer ("RVF" model) at various indicated rpm at 22° C. using appropriate spindles.

EXAMPLE I

The following example illustrates the use of (2-chloroethyl)morpholine (CEM) starch derivatives in the process of the present invention.

A 71 water fluidity (WF) waxy maize starch was treated with various levels of CEM so as to obtain starch derivatives containing 0.27%N, and 0.38%N. A zero point charge (ZPC) plot of the morpholine derivative indicates that the pK for the starch derivatives is approximately 6.5. Thus, above pH 6.5 the amine group looses its cationic charge and this starch derivative can be added to a coating formulation at a pH of 8.0–8.5 without causing flocculation of the coating.

These starches were evaluated in the following coating formulation 100 parts Nusheen (Kaolin clay from Engelhard)
0.1 parts tetrasodium pyrophosphate
4 parts starch (3/1 ratio cationic starch to noncationic starch)

Brookfield viscosities vs. final pH of the coating formulations are shown in Table I. While there are variations within experimental error, the Brookfield viscosity data for the coating formulations generally show that when the final pH of the coating formulation is at or slightly above formulation is below 8.0, the Brookfield viscosities begin to increase and continue to increase as the pH is decreased. The increase in viscosity of the formulations corresponds to the increase in cationicity of the morpholine starch derivative which occurs as the pH is lowered.

Thus, the use of a tertiary amine starch derivative with a low pK value such as the CEM derivative permits the need for only a slight amount of ammonia to raise the pH to the point where the starch derivative can be added to the pigment and not induce flocculation. The testing results in Table I also indicate whether or not pigment shock, i.e. premature flocculation, occurred when the cationic starch was mixed into the pigment dispersion.

TABLE I

| Starch Cook pH | Clay Slurry pH | Pigment Shock | Final Coating | 20 rpm Brkfld | 100 rpm Brkfld |
|---|---|---|---|---|---|
| 3.7% CEM (0.27% N) | | | | | |
| 5 | 10.5 | none | 9.3 | 1425 | 460 |
| 9 | 9 | none | 8.6 | 1725 | 560 |
| 8 | 9 | none | 8.3 | 1850 | 610 |
| 9 | 8 | none | 8.3 | 1425 | 460 |
| 7 | 9 | light | 7.8 | 3200 | 1080 |
| 8 | 8 | light | 7.8 | 5600 | 1860 |
| 9 | 7 | none | 7.7 | 2075 | 665 |
| 7 | 8 | moderate | 7.2 | 9250 | 3000 |
| 5.5% CEM (0.38% N) | | | | | |
| 5 | 10.5 | light | 9.2 | 2650 | 940 |
| 9 | 9 | light | 8.6 | 3150 | 1010 |
| 8 | 9 | none | 8.3 | 4150 | 1340 |
| 9 | 8 | light | 8.3 | 3850 | 1260 |
| 7 | 9 | moderate | 8 | 8000 | 2550 |
| 8 | 8 | light | 7.9 | 10200 | 3440 |
| 9 | 7 | light | 7.9 | 7000 | 2240 |
| 7 | 8 | moderate | 7.3 | 17750 | 6000 |
| 5.5% CEM (0.38% N) | | | | | |
| 5 | 10.5 | light | 9.2 | 2650 | 940 |
| 9 | 9 | light | 8.6 | 3150 | 1010 |
| 8 | 9 | none | 8.3 | 4150 | 1340 |
| 9 | 8 | light | 8.3 | 3850 | 1260 |
| 7 | 9 | moderate | 8 | 8000 | 2550 |
| 8 | 8 | light | 7.9 | 10200 | 3440 |
| 9 | 7 | light | 7.9 | 7000 | 2240 |
| 7 | 8 | moderate | 7.3 | 17750 | 6000 |

This example illustrates the use of N-(2-chloroethyl-)iminobis-(methylene)diphosphonic acid (CMPA) derivatized starch for use herein.

CMPA is a starch reactive reagent which contains a tertiary amino group as well as two phosphonic acid groups. The pK of the tertiary amino nitrogen is approximately 7.0–7.5.

A 71 WF waxy was treated with either 2.5%, 5.0%, or 10% CMPA. The corresponding starch derivatives contained 0.1%, 0.16%, and 0.26% nitrogen. These starches were evaluated in the same coating formulation as the morpholine treated starches of Example I, but using 4 parts of the cationic starch. Brookfield viscosity data for the formulations versus pH are shown in Table II. The data show that increased CMPA treatment results in higher coating viscosities. In general, above pH 8.5 the viscosities of the formulations remain constant; however, as the pH drops below approximately 8.0–8.5 the viscosity of the formulations increase. The pH at which the viscosity increases corresponds to the pK value of the tertiary amine present in the CMPA substituent.

TABLE II

| Starch Cook pH | Clay Slurry pH | Pigment Shock | Final Coating | 20 rpm Brkfld | 100 rpm Brkfld |
|---|---|---|---|---|---|
| 2.5% CMPA (0.10% N) | | | | | |
| 6.2 | 10.5 | none | 10.2 | 1300 | 395 |
| 10.5 | 8.5 | none | 9.8 | 1400 | 425 |
| 9.0 | 9.0 | none | 8.9 | 1625 | 510 |
| 8.0 | 9.0 | none | 8.6 | 1625 | 505 |
| 7.0 | 9.0 | none | 8.3 | 1800 | 565 |
| 8.0 | 8.0 | slight | 8.0 | 4150 | 1200 |
| 7.0 | 8.0 | slight | 7.8 | 3450 | 1040 |
| 9.0 | 6.7 | moderate | 7.5 | 7900 | 1980 |
| 5% CMPA (0.16% N) | | | | | |
| 6.6 | 10.5 | none | 9.7 | 2750 | 850 |
| 10.5 | 8.5 | none | 9.5 | 3400 | 1060 |
| 9.0 | 9.0 | slight | 8.6 | 6200 | 1720 |
| 8.0 | 9.0 | light | 8.5 | 7000 | 1880 |
| 8.0 | 8.0 | light | 8.0 | 7800 | 2300 |
| 7.0 | 9.0 | moderate | 7.8 | 12500 | 3100 |
| 7.0 | 8.0 | moderate | 7.6 | 16750 | 4100 |
| 9.0 | 6.7 | severe | 7.3 | 20000 | 4750 |
| 10% CMPA (0.26% N) | | | | | |
| 7.5 | 10.5 | light | 9.7 | 9600 | 2720 |
| 10.5 | 8.5 | light | 9.5 | 9500 | 2580 |
| 9.0 | 9.0 | light | 8.6 | 12500 | 3260 |
| 8.0 | 9.0 | severe | 8.3 | 20000 | 5000 |
| 8.0 | 8.0 | severe | 7.8 | 25500 | 6250 |
| 7.5 | 9.0 | severe | 7.8 | 24250 | 6200 |
| 7.5 | 8.0 | severe | 7.4 | 36000 | 8400 |
| 9.0 | 6.7 | severe | 7.2 | 27500 | 6850 |

EXAMPLE III

This example illustrates the use of a 2-(N-chloroacetamido-propyl) pyridine containing starch derivative.

In order to prepare a starch reactive reagent containing a pyridine group, 2-aminoethylpyridine was reacted with chloroacetylchloride to prepare the corresponding starch reactive chloroacetamide. A 50 WF amioca was reacted with 6% of the pyridine-containing reagent to obtain the corresponding starch derivative (0.2% N). A ZPC plot of this derivative indicates that the pK of the amine was approximately 5.5.

The starch was once again evaluated in coating formulations as in Example II in which the final pH of the formulations were varied. Brookfield viscosities of the formulations showed similar viscosities were obtained when the final pH of the coating formulations were 7.8 or higher. Below this pH range the viscosities began to increase greatly as would be expected since the tertiary amine-containing starch becomes more cationic as the pH decreases.

TABLE III

| | Coating pH | Brookfield Viscosity 20 rpm | Brookfield Viscosity 100 rpm |
|---|---|---|---|
| 6% pyridine modification, (0.20% N) | 9.8 | 9200 | 2780 |
| | 9.3 | 9300 | 2820 |
| | 8.8 | 9300 | 2820 |
| | 8.3 | 9500 | 2860 |
| | 7.8 | 10,600 | 3140 |
| | 7.4 | 13,200 | 3650 |
| | 7.0 | 17,500 | 4750 |
| | 6.5 | 23,500 | 6200 |
| | 6.0 | 30,500 | 8250 |
| | 5.6 | 42,500 | 11450 |
| | 5.2 | 62,000 | 18800 |

EXAMPLE IV

This example illustrates the use of morpholine-containing starch derivatives.

The 50 WF amioca-based morpholine derivatives were prepared as in Example I but using 2-chloroethylmorpholine so as to obtain starch derivatives containing approximately 0.30% nitrogen and 0.40% nitrogen. The resultant derivatives were formulated into paper coatings as described in Example II and tested as described above. The results are presented in Table IV. In addition, Table IV illustrates comparative test results obtained using a hydroxy-ethylated starch control (Penford Gum 250).

TABLE IV

| | Coating pH | Brookfield Viscosity 20 rpm | Brookfield Viscosity 100 rpm |
|---|---|---|---|
| 0.29% N | 8.5 | 3200 | 1260 |
| | 8.0 | 5800 | 2320 |
| | 7.5 | 22,000 | 8200 |
| | 7.0 | 68,000 | 26,400 |
| 0.41% N | 8.5 | 4200 | 1660 |
| | 8.0 | 14,000 | 5700 |
| | 7.5 | 72,000 | 28,400 |
| | 7.0 | too high to determine | |
| Hydroxy-ethylated reference control Penford Gum 250 | 8.5 | 4300 | 1460 |
| | 8.0 | 4100 | 1380 |
| | 7.5 | 4000 | 1340 |
| | 7.0 | 4200 | 1400 |

Four parts of the 0.41% N treated starch derivative produced in this example were formulated with 2 parts Union 3103 from Unocal (a vinyl acrylic latex) and 100 parts pigment to form a paper coating which was run on a pilot paper coater at approximately 3000 ft./min. and tested for paper coating properties using the following test procedures:

Gloss-Hunterlab Glossmeter D48-7,75° Optical Sensor (conforms to TAPPI Standard Test Method T480).

Brightness-Technidyne Brightmeter Micro S-5 (conforms to TAPPI Standard Test Method T452).

Opacity-Technidyne Brightmeter Micro S-5 (conforms to TAPPI Standard Test Method T425).

Smoothness-Parker Print Surf Test M750, at 10 psi with rubber backing.

Roto Missed Dots-TMI K-Print Proofer K-101 with a 150 line screen, 105 u dot etched plate. Values are number of missing dots/cm$^2$. Roto Ink Gloss-Sunvure Type B black ink, (values are 75° gloss measurements).

The results of these tests are shown in Table V. Also included in Table V are test results obtained using a conventionally employed binder system as a control (all results are based on a coating weight of 6.5 pounds per ream applied to the wire side of a light weight, groundwood containing base sheet).

TABLE V

| Starch | Gloss | Bright | Opacity | Smoothness | Roto Print Missed Dots | Roto Print Ink Gloss |
|---|---|---|---|---|---|---|
| 0.41% N | 66.3 | 64.5 | 79.9 | 0.85 | 38 | 91 |
| Control | 59.3 | 64.8 | 79.8 | 0.95 | 40 | 89.2 |
| Control | 6 parts vinyl acrylic latex plus a thickener with no starch | | | | | |

Note, in particular, the improved gloss, smoothness and roto print quality of the CEM containing system with brightness and opacity comparable to the conventionally utilized control system. This demonstrates some of the improved coated sheet properties that result from use of the rapidly immobilizing coatings of the present invention.

EXAMPLE V

This example illustrates the use of diethylaminoethylchloride(DEC) starch derivatives. Diethylaminoethylchloride is a starch-reactive reagent which contains a tertiary amino nitrogen that has a pK value of approximately 10.0.

A fluidity waxy starch derivative with a WF value of 65.5 was reacted with 3.25% diethylaminoethylchloride to yield the corresponding cationic tertiary amine derivative containing 0.24% N. The starch derivative was evaluated in the same coating formulation as the morpholine treated starches of Example I except that the four parts starch used in the formulation was made up of 3 parts of the DEC-treated cationic starch and one part fluidity waxy (65.5 WF).

Brookfield viscosity data for the formulations vs. pH are shown in Table VI.

TABLE VI

| | Coating pH | Brookfield Viscosity (20 rpm) |
|---|---|---|
| 3.25% Diethylaminoethylchloride | 11.0 | 4200 |
| | 10.5 | 10000 |
| | 10.0 | 29250 |
| | 9.5 | 38000 |
| | 9.0 | 47500 |
| | 8.5 | 50000 |

The data illustrate that a relatively high concentration of alkali is needed to formulate above the ZPC of the DEC treated starch and for this reason it is not particularly preferred for use herein. At pH 11.0, there is a slight interaction occurring between the cationic starch and the clay since the DEC-treated starch still has some cationic nature at this high pH. The data also show that as the pH is lowered to 10.5 and below, the viscosity of the formulation rapidly increases which corresponds to an increase in the cationicity of the DEC-treated starch derivative.

EXAMPLE VI

This example illustrates the use of a cationic starch derivative produced by reaction of starch with a polycationic reagent containing two tertiary amine groups and one starch reactive group.

A fluidity waxy maize (50 WF) was reacted with either 4% or 8% 1,3-bis(morpholino)-2-chloropropane. The corresponding starch derivatives were found to contain 0.35% N and 0.67% N respectively. ZPC plots of the two starch derivatives showed that the pK's of the diamine substituent was approximately 6.5, similar to that of previously described monomorpholine-containing starch derivatives. The following formulation was used to evaluate these starch derivatives.

100 parts clay
0.2 parts Dispex N-40, (a dispersant from Allied Colloids)
4.0 parts starch derivative
1.0 parts C-104, (a lubricant from Nopco Chemical)
2.0 parts Resyn 6838, (a vinyl acrylic latex from National Starch and Chemical Corp.)

Brookfield viscosity data for the formulations vs pH are shown in Table VII.

TABLE VII

| | | Brookfield Viscosities | |
|---|---|---|---|
| | Coating pH | 20 rpm | 100 rpm |
| 0.35% N | 9.2 | 2200 | 810 |
| dimorpholine substituent | 8.8 | 2200 | 810 |
| | 8.3 | 2650 | 2650 |
| | 7.8 | 14000 | 5000 |
| | 7.4 | 44600 | 13400 |
| 0.67% N | 9.2 | 2700 | 1000 |
| dimorpholine substituent | 8.7 | 3400 | 1240 |
| | 8.2 | 13250 | 4700 |
| | 7.8 | 38000 | 13000 |
| | 7.4 | 50000 | 17200 |

As shown by the data, when the pH of the final coating formulation is above approximately 8.0 to 8.5 there is little or no interaction between the starch and clay which results in a satisfactory low viscosity. As the final pH of the formulations decrease the viscosities of the formulations increase due to the ditertiary amine substituent becoming more cationic.

Similar results would be achieved using other cationic derivatives prepared from various other starch, gum or cellulose bases as discussed previously.

We claim:

1. A process for rapidly immobilizing paper coating compositions on paper substrates comprising the steps of:

a) formulating an aqueous coating composition comprising by weight of the total solids content of the coating composition, 5 to 90% binder at least 1% of which is a non-quaternary amine-containing cationic starch derivative, 10 to 95% pigment, formulated in water to a solids level of 20 to 80% by weight, and sufficient base to obtain a pH above the pK of the starch derivative so that the starch derivative is no longer cationic;

b) coating the paper substrate with an effective amount of the paper coating composition;

c) lowering the pH of the paper coating composition such that the starch derivative becomes cationic.

2. The process of claim 1 wherein the pH is lowered by drying the coating so as to evaporate the base.

3. The process of claim 1 wherein the pH is lowered by reaction with an acidic component.

4. The process of claim 1 wherein the cationic starch derivative has a pKa greater than about 5.5.

5. The process of claim 4 wherein the cationic starch derivative has a pKa greater than about 6.5.

6. The process of claim 1 wherein the cationic starch derivative is prepared by reaction of a starch with a reagent selected from the group consisting of N-(2-chloroethyl)-morpholine;
N-(2-chloropropyl)-morpholine;
N-(2-chloroisobutyl)-morpholine;
N-(2-chloropentyl)-morpholine;
N-(2-bromohexyl)-morpholine;
N,N-Diisopropyl-2,3-epoxypropylamine;
N-ethyl-N-2-hydroxyethyl-2,3-epoxypropylamine;
N-methyl-N-2-hydroxyethyl-2,3-epoxypentylamine;
N,N-Diisoamyl-2,3-epoxypentylamine;
N-hexyl-N-2-hydroxyethyl-2,3-epoxybutylamine;
N,N-Diisoheptyl-2,3-epoxybutylamine;
N-phenyl-N-ethyl-2,3-epoxypropylamine;
N-methyl-N-naphthyl-2,3-epoxypropylamine;
N-propyl-N-(2-hydroxyethyl-)-2,3-epoxybutylamine;
N,N-diisopropyl-2,3-epoxypentylamine;
N,N-bis-2-hydroxypropyl-2,3-epoxypropylamine;
N,N-bis-2-hydroxybutyl-2,3-epoxyhexylamine;
N,N-bis-2-hydroxyisopropyl-2,3-epoxybutylamine;
N,N-bis-2-hydroxyisoamyl-2,3-epoxypentylamine;
N-(2,3-epoxypropyl)-morpholine;
N-(2,3-epoxyhexyl)-morpholine;
N-(2,3-epoxyisoamyl)-morpholine;
N-(2-chloroethyl)-N-ethylaniline;
N-(2-bromoethyl)-N-butylaniline;
N-(2-chloropropyl)-N-isopropylaniline;
N-(2-chlorobutyl)-N-pentylaniline;
N-(2-chloroethyl)-N-morpholine-N-oxide;
N-(2-chloroethyl)-N,N-diethylamine-N-oxide;
N-(2,3-epoxypropyl)-morpholine-N-oxide;
N-(2-chloroethyl)N-benzyl-N-methylamine;
N-(2-chloroethyl)N-benzyl-N-(2-methoxyethyl)amine;
3-picoylchloride;
4-picoylchloride;
N-(2-chloroethyl)iminobis-(methylene)diphosphonic acid;
Diethylaminoethylchloride;
4-(2-chloroethyl)moropholine hydrochoride;
1,3-bis(morpholino)-2-chloropropane; and
2-(N-chloroacetomido-propyl)pyridine.

7. The process of claim 1 wherein the paper coating composition contains by weight of the total solids content of the coating composition 10 to 95% pigment, 5 to 90% binder at least 1% of which is the cationic starch derivative, and 0 to 5% additives, and is formulated in water to a solids level of 20 to 80% by weight.

8. The process of claim 1 wherein the paper coating composition comprises by weight 5 to 90% binder, at least 1% of which is a non-quaternary amine-containing cationic starch derivative, the remaining percentage of which is selected from the group consisting of starch other than a non-quaternary amine-containing cationic starch derivative, casein, protein, polyvinyl acetate, polyvinyl acetate-acrylate copolymers, acrylic copolymers, ethylene vinyl acetate copolymer, styrene butadiene and styrene acrylate latices.

9. The process of claim 1 wherein the cationic starch derivative is a (2-chloroethyl) morpholine derivative.

10. The process of claim 1 wherein the cationic starch derivative is a N-(2-chloroethyl)iminobis(methylene) diphosphonic acid derivative.

11. The process of claim 1 wherein the cationic starch derivative is a 1,3-bis(morpholino)-2-chloropropane derivative.

12. A rapidly immobilizable paper coating composition comprising by weight of the total solids content of the coating composition, 5 to 90% parts binder at least 1% of which is a non-quaternary amine-containing cationic starch derivative, 10 to 95% pigment, water and sufficient base to obtain a pH above the pKa of the starch derivative.

13. The paper coating composition of claim 12 comprising by weight of the total solids content, 5 to 90% binder, at least 1% of which is a non-quaternary amine-containing cationic starch derivative, the remaining percentage of which is selected from the group consisting of starch other than a non-quaternary amine-containing cationic starch derivative, casein, protein, polyvinyl acetate, polyvinyl acetate-acrylate copolymers, acrylic copolymers, ethylene vinyl acetate copolymer, styrene butadiene and styrene acrylate latices.

14. The paper coating composition of claim 12 wherein the cationic starch derivative has a pK greater than about 5.5.

15. The paper coating composition of claim 12 wherein the cationic starch derivative has a pK greater than about 6.5.

16. The paper coating composition of claim 12 wherein the cationic starch derivative is prepared by reaction of a starch with a reagent selected from the group consisting of N-(2-chloroethyl)-morpholine;
N-(2-chloropropyl)-morpholine;
N-(2-chloroisobutyl)-morpholine;
N-(2-chloropentyl)-morpholine;
N-(2-bromohexyl)-morpholine;
N,N-Diisopropyl-2,3-epoxypropylamine;
N-ethyl-N-2-hydroxyethyl-2,3-epoxypropylamine;
N-methyl-N-2-hydroxyethyl-2,3-epoxypentylamine;
N,N-Diisoamyl-2,3-epoxypentylamine;
N-hexyl-N-2-hydroxyethyl-2,3-epoxybutylamine;
N,N-Diisoheptyl-2,3-epoxybutylamine;
N-phenyl-N-ethyl-2,3-epoxypropylamine;
N-methyl-N-naphthyl-2,3-epoxypropylamine;
N-propyl-N-(2-hydroxyethyl-)-2,3-epoxybutylamine;
N,N-diisopropyl-2,3-epoxypenylamine;
N,N-bis-2-hydroxypropyl-2,3-epoxypropylamine;
N,N-bis-2-hydroxybutyl-2,3-epoxyhexylamine;
N,N-bis-2-hydroxyisopropyl-2,3-epoxybutylamine;
N,N-bis-2-hydroxyisoamyl-2,3-epoxypentylamine;
N-(2,3-epoxypropyl)-morpholine;
N-(2,3-epoxyhexyl)-morpholine;
N-(2,3-epoxyisoamyl)-morpholine;
N-(2-chloroethyl)-N-ethylaniline;
N-(2-bromoethyl)-N-butylaniline;
N-(2-chloropropyl)-N-isopropylaniline;
N-(2-chlorobutyl)-N-pentylaniline;
N-(2-chloroethyl)-N-morpholine-N-oxide;
N-(2-chloroethyl)-N,N-diethylamine-N-oxide;
N-(2,3-epoxypropyl)-morpholine-N-oxide;
N-(2-chloroethyl)N-benzyl-N-methylamine;
N-(2-chloroethyl)N-benzyl-N-(2-methoxyethyl)amine;
3-picoylchloride;
4-picoylchloride;
N-(2-chloroethyl)iminobis-(methylene)diphosphonic acid;
Diethylaminoethylchloride;
4-(2-chloroethyl)moropholine hydrochoride;
1,3-bis(morpholino)-2-chloropropane; and
2-(N-chloroacetomido-propyl)pyridine.

17. The paper coating composition of claim 12 comprising 10 to 95% pigment, 5 to 90% binder at least 1% of which is the cationic starch derivative, 0 to 5% additives, and is formulated in water to a solids level of 20 to 80% by weight.

18. The paper coating composition of claim 12 wherein the cationic starch derivative is a (2-chloroethyl)morpholine derivative.

19. The paper coating composition of claim 12 wherein the cationic starch derivative is a N-(2-chloroethyl)iminobis(methylene)diphosphonic acid derivative.

20. The paper coating composition of claim 12 wherein the cationic starch derivative is a 1,3-bis(morpholino)-2-chloropropane derivative.

* * * * *